United States Patent [19]

Grandvallet et al.

[11] Patent Number: 4,494,579

[45] Date of Patent: Jan. 22, 1985

[54] THREAD CLAMP, PARTICULARLY FOR JET LOOMS

[75] Inventors: Gilles Grandvallet; Albert H. Deborde, both of Bourgoin Jallieu, France

[73] Assignee: Saurer Diederichs Societe Anonyme, Bourgoin Jallieu, France

[21] Appl. No.: 549,930

[22] Filed: Nov. 8, 1983

[30] Foreign Application Priority Data

Nov. 8, 1982 [FR] France ..... 82 1904

[51] Int. Cl.[3] ..... D03D 47/00

[52] U.S. Cl. ..... 139/429; 139/435; 139/450

[58] Field of Search ..... 139/429, 435, 450, 302; 188/65.1, 65.2

[56] References Cited

U.S. PATENT DOCUMENTS 3,951,179 4/1976 Pfarrualler ..... 139/302
4,084,623 4/1978 Tojo et al. ..... 139/435
4,134,435 1/1979 Cornellier ..... 139/435
4,450,874 5/1984 Brouwer et al. ..... 139/429

*Primary Examiner*—Henry S. Jaudon
*Attorney, Agent, or Firm*—Karl F. Ross; Herbert Dubno

[57] ABSTRACT

A thread clamp, designed for periodically retaining a weft yarn in a loom of the shuttleless type, comprises a housing with a stationary insert having front and rear recesses spanned by respective membranes defining therewith two chambers of variable volume, the membranes being interconnected by a stem passing with clearance through a passage in the insert. One end of the stem, projecting beyond the front membrane, carries a movable jaw normally held against a confronting fixed jaw by a biasing spring disposed in the front compartment. The rear chamber, whose membrane is of larger effective diameter than that of the front chamber, can be expanded by the admission of air under pressure through one or more passages in the insert, the difference in membrane area being sufficient to let the resulting pressure differential in the two chambers overcome the force of the biasing spring to separate the movable jaw from the fixed jaw.

12 Claims, 4 Drawing Figures

THREAD CLAMP, PARTICULARLY FOR JET LOOMS

FIELD OF THE INVENTION

Our present invention relates to a thread clamp to be used as a weft brake in a so-called jet loom, i.e. a loom of the shuttleless type operating with pneumatic insertion, in which the weft yarn must be periodically arrested during reformation of a shed before being released to an insertion nozzle.

BACKGROUND OF THE INVENTION

A thread clamp of this nature is usually mounted on one side of the loom frame as close as possible to an insertion nozzle in which a cut-off end of the weft yarn remains while the shed is being reformed, this positioning being desirable in order to prevent an accidental withdrawal of the weft end from the nozzle due to the elasticity of the yarn. Reference in this connection may be made, for example, to commonly owned application Ser. No. 331,922 filed Dec. 17, 1981 by one of us —Albert Henri Deborde—jointly with another, now U.S. Pat. No. 4,448,223.

Conventionally, thread clamps used for the purpose described include a fixed and a movable jaw, the latter being operable by a single-acting pneumatic jack to which air under pressure is applied when the clamp is to close around the weft yarn; when the air pressure is relieved, a countervailing biasing spring reopens the clamp. Such an arrangement has the drawback that the exerted clamping pressure is a function of the air pressure which may be subject to significant variation, e.g. when the loom includes two or more nozzles for the alternate insertion of different weft yarns. Moreover, the reopening of the clamp by means of a biasing spring is somewhat sluggish which, since the release of the weft must be precisely synchronized with the loom cycle, impedes high-speed operation.

OBJECT OF THE INVENTION

The object of our invention, therefore, is to provide an improved thread clamp for the purpose set forth in which these drawbacks are eliminated.

SUMMARY OF THE INVENTION

A thread clamp according to our invention comprises a housing with an apertured front wall and an insert bracketed by a first and a second deformable membrane within the housing, the first membrane defining with a front surface of that insert a first chamber adjacent the front wall while the second membrane defines with a rear surface of the insert a second chamber remote from that front wall. The insert has a throughgoing passage, substantially perpendicular to the front wall of the housing, which is traversed with clearance by a stem fixedly secured to both membranes; the stem projects beyond the front wall and terminates in a movable jaw that confronts a fixed jaw secured to the housing and contacts it in a forward position of the stem in which the first and the second chamber respectively have a maximum and a minimum volume. The stem is coupled with spring means, preferably a coil spring surrounding it inside the first chamber, biasing it toward the aforementioned forward position. The housing is further provided with conduit means opening into the second chamber, the conduit means being selectively connectable by suitable control means such as a solenoid valve to a source of high-pressure air and to the atmosphere. A mobile portion of the second membrane is wider than a mobile portion of the first membrane whereby air under pressure admitted into the second chamber, which communicates with the first chamber through the clearance surrounding the stem, creates a pressure differential sufficient to move the stem into a retracted position against the biasing force of the spring means.

With the stem floatingly supported by the two membranes by reason of its loose guidance in the passage of the insert, the movable jaw will automatically find the proper contact position with the fixed jaw when the chambers are vented to the atmosphere so that the spring force is effective to move the stem forward. The reclamping of a weft yarn between the two jaws can generally occur more slowly than its release at the beginning of an injection operation. The thread-clamping force, being supplied by a spring, is independent of the available air pressure which is needed only during unclamping.

A more particular feature of our invention resides in the provision, within the second chamber, of an enlargement on the stem which obstructs the passage of the insert in the forward position of jaw closure. Thus, the air pressure generated in the second chamber is initially fully effective to retract the stem and is only then communicated to the first chamber so as to slow its backward motion. This insures a quick but controlled release of the engaged weft. The enlargement may be part of a head fastened onto a rear end of the stem, the mobile portion of the second membrane being traversed by and secured to that head. The latter may also serve as a convenient abutment for stopping the rearward motion of the stem by coming to rest against another housing wall, advantageously a cover detachably secured to the housing body opposite its apertured front wall. The second membrane can then be peripherally gripped between the cover and the insert while the first membrane is similarly gripped between the insert and the front wall. The mobile portion of the first membrane can be gripped between the movable jaw and a washer through which the aforementioned biasing spring bears upon that membrane.

The insert, advantageously, is formed with a front recess and a rear recess which are respectively spanned by the first and the second membrane to form the two intercommunicating chambers.

BRIEF DESCRIPTION OF THE DRAWING

The above and other features of our invention will now be described in detail with reference to the accompanying drawing in which.

SPECIFIC DESCRIPTION

Figure 1:
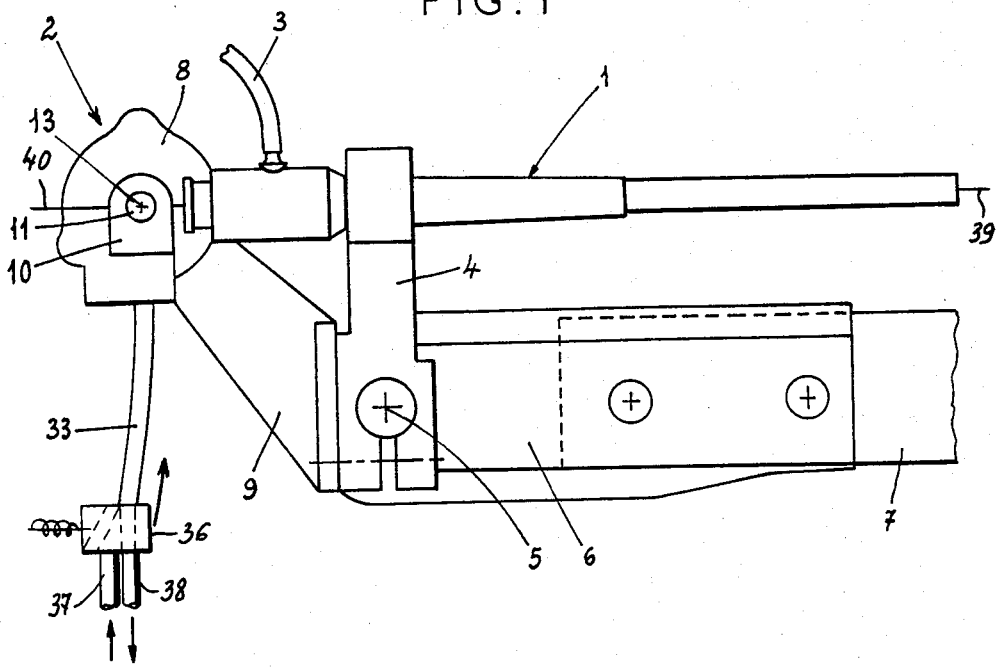
FIG. 1 is a somewhat diagrammatic view of part of a jet loom provided with a thread clamp according to this invention.
Figure 2:
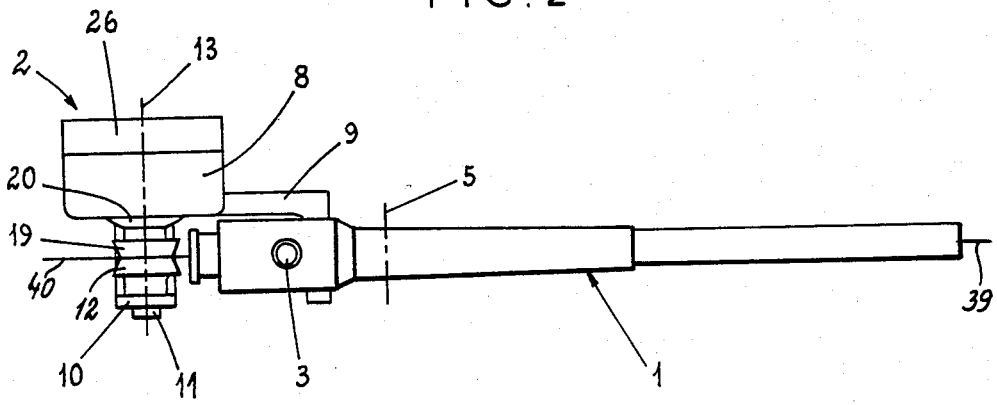
FIG. 2 is a top view of the assembly of FIG. 1.

In FIGS. 1 and 2 we have shown part of a batten 7 of a conventional jet loom on an extension 6 of which an insertion nozzle is swingably mounted by an arm 4 that is pivotable about a fulcrum 5 in the manner and for the purpose described in commonly owned application Ser.

No. 331,922. Air under pressure is periodically admitted to nozzle 1 via a flexible tube 3, by a compressor or an accumulator not further illustrated, to introduce the end 39 of a weft yarn 40 as a pick into a shed formed by associated warp threads. The yarn 40 passes between a movable jaw 19 and a fixed jaw 12 of a thread clamp 2 according to our invention, more fully described hereinafter with reference to FIGS. 3 and 4. The thread clamp 2 is supported on batten 7 by means of an arm 9 having an elbow-shaped extension 10 on which the fixed jaw 12 is mounted with the aid of a screw 11.

Figure 3:
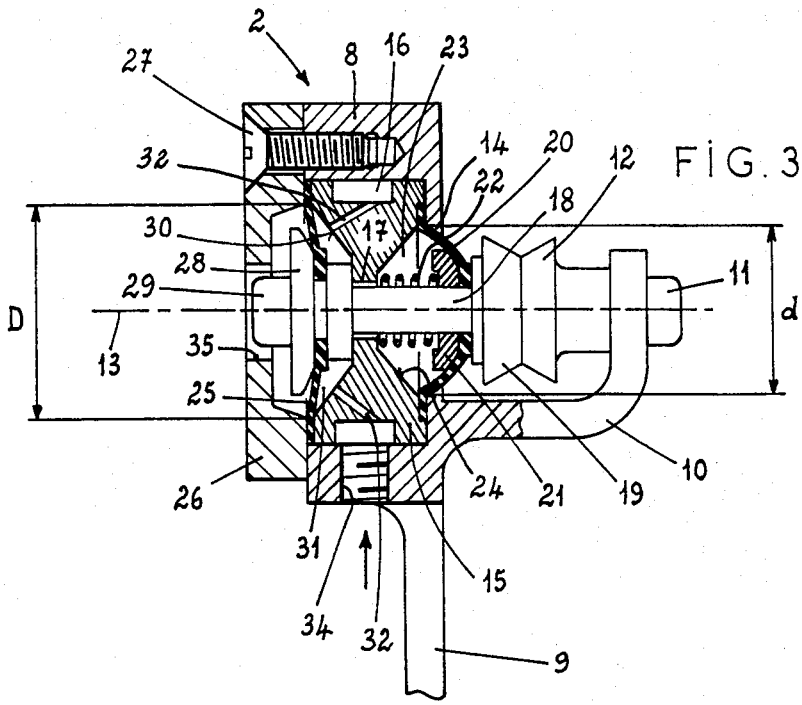
FIG. 3 is a detail view of the thread clamp—shown closed—in axial section, drawn to a larger scale.
Figure 4:
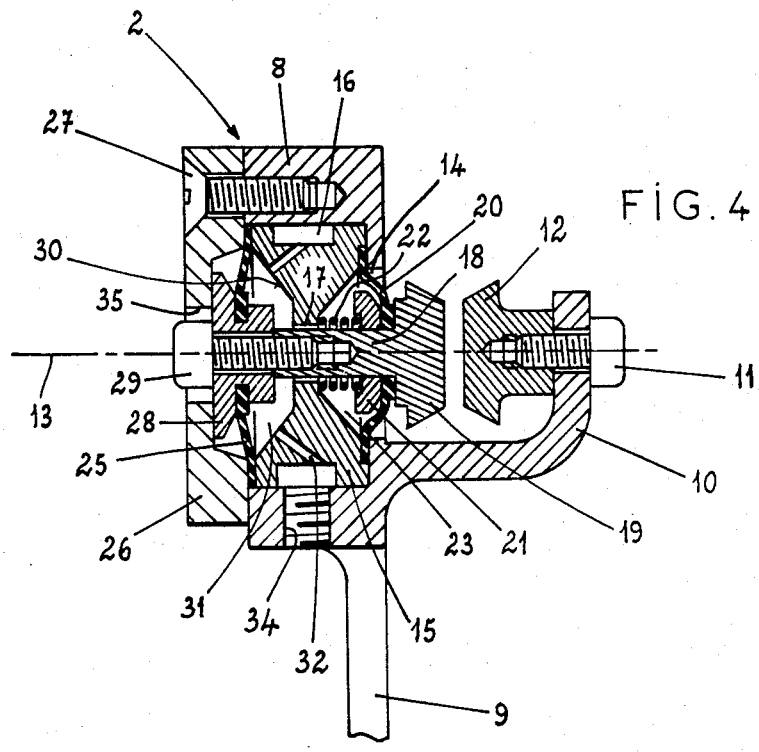
FIG. 4 is a view similar to FIG. 3 but showing the thread clamp in an open position.

The thread clamp 2 comprises a generally cylindrical housing 8 centered on an axis 13 and provided, at its rear side remote from jaws 12 and 19, with a removable cover 26 more fully illustrated in FIGS. 3 and 4. The front side of housing 8 has a wall with a large aperture 14 penetrated by a mobile portion of an elastic membrane 20 whose peripheral zone is gripped between that front wall and a stationary insert 15 disposed in the housing. Another such membrane 25 is peripherally gripped between the rear surface of insert 15 and the cover 26, the latter being held into the housing body by several screws 27 (only one shown). The front and rear surfaces of insert 15 have generally frustoconical recesses 24 and 30 which are spanned by the membranes 20 and 25 to define therewith a first chamber 23 and a second chamber 31; the cross-sectional area of chamber 31 perpendicular to axis 13, as given by the effective diameter of membrane 25, is wider than the corresponding area of chamber 23. The movable jaw 19 is rigid with a stem 18 received with all-around clearance in a central aperture 17 of insert 15. The front extremity of stem 18 terminating in jaw 19 traverses the membrane 20 to which it is secured by a washer 21 within chamber 23, this washer being under pressure of a coil spring 22 in that chamber which forces the central part of membrane 20 against the jaw 19 and urges that jaw along with stem 18 in a generally axial direction toward jaw 12. The rear extremity of stem 18 carries a head 28 which traverses the membrane 25 and has an annular groove receiving an inner peripheral zone of its mobile portion. Head 28 is attached to stem 18 by a bolt 29 which is threaded into that stem and has a head freely movable in a circular cutout 35 of cover 26.

Insert 15 is further provided with a peripheral groove 16 communicating with a threaded aperture 34 into which a flexible conduit 33 (FIG. 1) is screwed; a plurality of bores 32 extend generally axially from groove 16 to chamber 31 so as to be roughly perpendicular to the mobile portion of membrane 25.

As further illustrated in FIG. 1, conduit 33 terminates at a solenoid valve 36 which is operable, by control means not further illustrated, to connect that conduit either with a supply tube 37 or with a venting tube 38; tube 37 extends from a non-illustrated source of compressed air while tube 38 opens into the surrounding atmosphere.

FIG. 3 illustrates the normal or quiescent position of thread clamp 2 in which jaws 19 and 12 are virtually closed to retain a weft yarn 40 (FIGS. 1 and 2) between them. This position comes into existence when valve 36 vents the interior of housing 8 to the atmosphere by way of tube 38 so that coil spring 22 is effective to expand the chamber 23 at the expense of chamber 31 whereby membrane 20 bulges outward through aperture 14 as stem 18 is extended. Head 28 is in contact with the bottom of recess 30 of insert 15 so as to obstruct the clearance 17 whereby the two chambers are effectively isolated from each other.

When solenoid valve 36 is reversed to release the engaged weft thread, high-pressure air from tube 37 enters chamber 31 via groove 16 and bores 32; the force of the entering air streams is directed almost perpendicularly upon membrane 25 which quickly retracts the stem 18 whereby jaw 19 separates from jaw 12. The removal of head 28 from surface 30 unblocks the passage 17 whereby the air pressure now prevailing in chamber 31 is communicated to chamber 23; since, however, the latter has a smaller effective cross-section than chamber 31, a differential pressure remains which is still sufficient to overcome the restoring force of spring 22 whereby stem 18 is fully retracted into the position of FIG. 4. The limit of retraction is reached when the head 28 comes to rest against the cover 26.

In any position intermediate those of FIGS. 3 and 4, stem 18 is limitedly swivelable in passage 17 on account of the existing clearance and its floating suspension by the elastic membranes 20 and 25 constituting its sole support. Notwithstanding any manufacturing tolerances, therefore, jaw 19 will be able to make full-face contact with its mate 12 in the absence of an interposed weft yarn.

The opening of the clamp jaws under air pressure enables the release of the weft yarn concurrently with the introduction of a pick through insertion nozzle 1 when the admission of compressed air to tubes 3 and 38 is jointly controlled by a common valve unit such as that described in a commonly owned application filed on even date herewith, in the names of Albert Henri Deborde and Pierre Remond, under Ser. No. 549,929 filed 11/8/83. A plurality of such thread clamps may be associated with different nozzles for the selective insertion of various weft yarns as described in that concurrently filed application.

We claim:

1. A thread clamp for temporarily arresting a weft yarn in a jet loom, comprising:

a housing with an apertured front wall;

a stationary insert in said housing having a throughgoing passage substantially perpendicular to said front wall;

a deformable first membrane in said housing defining with a front surface of said insert a first chamber adjacent said front wall;

a deformable second membrane in said housing defining with a rear surface of said insert a second chamber remote from said front wall, said second membrane having a mobile portion wider than a mobile portion of said first membrane, said chambers communicating with each other through said passage;

a stem traversing said passage with clearance while being fixedly secured to both said membranes, said stem projecting beyond said front wall and terminating in a movable jaw;

a fixed jaw secured to said housing and confronting said movable jaw for contact therewith in a forward position of said stem in which said first and said second chamber respectively have a maximum and a minimum volume;

spring means coupled with said stem for biasing same toward said forward position thereof;

conduit means in said housing opening into said second chamber; and control means for selectively connecting said conduit means to a source of high-pressure air and to the atmosphere, admission of high-pressure air to said second chamber by way of said conduit means generating a pressure differential moving said stem into a retracted position against the force of said spring means.

2. A thread clamp as defined in claim 1 wherein said stem is provided within said second chamber with an enlargement obstructing said passage in said forward position.

3. A thread clamp as defined in claim 2 wherein said enlargement is part of a head fastened onto a rear end of said stem, the mobile portion of said second membrane being traversed by and secured to said head.

4. A thread clamp as defined in claim 3 wherein said housing is provided with a detachable cover opposite said front wall, said second membrane being peripherally gripped between said cover and said insert.

5. A thread clamp as defined in claim 4 wherein said head abuts said cover in said retracted position.

6. A thread clamp as defined in claim 4 wherein said first membrane is peripherally gripped between said insert and said front wall.

7. A thread clamp as defined in claim 1 wherein said spring means comprises a coil spring surrounding said stem inside said first chamber.

8. A thread clamp as defined in claim 7, further comprising a washer surrounding said stem forwardly of said coil spring in said first chamber, the mobile portion of said first membrane being gripped between said washer and said movable jaw.

9. A thread clamp as defined in claim 1 wherein said insert is provided with a front recess and a rear recess respectively spanned by said first membrane and by said second membrane to form said first and second chambers.

10. A thread clamp as defined in claim 1 wherein said housing is integral with a mounting arm carrying said fixed jaw.

11. A thread clamp as defined in claim 1 wherein said insert has a peripheral groove communicating with said conduit means and at least one bore extending from said groove to said rear surface.

12. A thread clamp as defined in claim 11 wherein said bore extends generally perpendicularly to said second membrane.

* * * * *